US005213039A

United States Patent [19]

Takeda et al.

[11] Patent Number: 5,213,039

[45] Date of Patent: May 25, 1993

[54] PLATE LOCKUP APPARATUS FOR PRINTING PRESS

[75] Inventors: Koji Takeda; Nobuaki Saito, both of Ibaraki, Japan

[73] Assignee: Komori Corporation, Japan

[21] Appl. No.: 888,895

[22] Filed: May 26, 1992

[30] Foreign Application Priority Data

May 30, 1991 [JP] Japan ..... 3-48301[U]

[51] Int. Cl.[5] ..... B41F 1/28

[52] U.S. Cl. ..... 101/415.1; 101/378

[58] Field of Search ..... 101/415.1, 378, 410, 101/409, 408

[56] References Cited

U.S. PATENT DOCUMENTS

| | | | |
|---|---|---|---|
| 4,372,209 | 2/1983 | Jentzsch et al. | 101/409 |
| 4,759,290 | 7/1988 | Holl et al. | 101/409 |
| 4,860,651 | 8/1989 | Ishii et al. | 101/409 |
| 5,088,410 | 2/1992 | Murakami | 101/378 |
| 5,094,165 | 3/1992 | Sugiyama et al. | 101/378 |

FOREIGN PATENT DOCUMENTS

| | | | |
|---|---|---|---|
| 1192867 | 5/1970 | United Kingdom | 101/415.1 |

*Primary Examiner*—Edgar S. Burr

*Assistant Examiner*—Anthony H. Nguyen

*Attorney, Agent, or Firm*—Blakely, Sokoloff, Taylor & Zafman

[57] ABSTRACT

A plate lockup apparatus for a printing press includes a plate lockup table, a gripper plate, a spring member, an actuating member, a cam shaft, and an adjusting member. The plate lockup table is located in a gap of a circumferential surface of a plate cylinder and extends in an axial direction of the plate cylinder. The gripper plate is pivotally supported on the plate lockup table such that its gripper surface opposes to contact a gripper surface of the plate lockup table and extends in the axial direction of the plate cylinder. The spring member biases the gripper plate in a plate releasing direction. The actuating member is fixed on the gripping plate and extends in a radial direction of the plate cylinder. The cam shaft extends along the actuating member to be pivotal in the axial direction of the plate cylinder, such that its cam surface opposes to contact the actuating member to swing, by cooperation with the spring member, the gripper plate in the plate gripping direction and a plate releasing direction with respect to the plate lockup table through said actuating member. The adjusting member acts on the actuating member to adjust a relative position between the gripper surfaces.

4 Claims, 2 Drawing Sheets

PLATE LOCKUP APPARATUS FOR PRINTING PRESS

BACKGROUND OF THE INVENTION

The present invention relates to a plate lockup apparatus, arranged in a plate cylinder of a printing press, for fixing leading and trailing ends of a plate wound around the circumferential surface of the plate cylinder.

A gap having almost a rectangular section and a length almost equal to the overall length of a plate cylinder is formed in the circumferential surface of the plate cylinder for each of a variety of printing presses. A plate lockup apparatus consisting of a leading-side lockup device for gripping the leading end of a machine plate (to be referred to as a plate hereinafter) and a trailing-side lockup device for gripping the trailing end of the plate, gripped by the leading-side lockup device and then wound around the circumferential surface of the plate cylinder, is fixed on the bottom surface of the gap to extend in the axial direction of the plate cylinder.

Each of the conventional leading- and trailing-side lockup devices comprises an elongated lockup table extending in the axial direction of the plate cylinder, and gripper plates, pivotally supported by this lockup table, for gripping or releasing the plate with or from the lockup table by being opened or closed as they pivot. In the vicinity of notches formed in the gripper plates, a cam shaft having a plurality of cams which can be respectively engaged with these notches extend along the axial direction of the plate cylinder. If the apparatus is of the spring closed type, compression coil springs are interposed between the gripper plates and the lockup table to bias the gripper plates toward the lockup table in a closing direction. In addition, a plate tightening unit having compression coil springs for biasing the gripper plates in a plate tightening direction is provided to the trailing-side lockup device.

With the above arrangement, in order to grip the plate, when the leading-side cam shaft is pivoted manually or by a drive unit, the gripper plates are urged by the cam surfaces of the cams and opened against the elastic forces of the compression coil springs. An end portion of the plate is inserted between the gripper surfaces of the gripper plates and the lockup table. When the cam shaft is pivoted in the direction opposite to the direction described above, the gripper plates are released from the opening operation by the cam surfaces and closed by the elastic forces of the compression coil springs, thereby gripping the leading end of the plate. Then, when the plate cylinder is rotated by almost one revolution, the plate is wound around the circumferential surface of the plate cylinder. Thus, the trailing-side lockup device is caused to grip the trailing end of the plate in a manner similar to that described above, and the trailing-side lockup device is moved along the circumferential direction of the plate cylinder by the plate tightening unit, so that the plate is brought into tight contact with the circumferential surface of the plate cylinder.

In the conventional plate lockup apparatus described above, the plate gripping force must be adjusted in accordance with the thickness or the like of the plate. In the conventional spring closed type plate lockup apparatus described above, to adjust the gripping force of the leading-side plate lockup device, the spring forces of the compression coil springs (described above) for biasing the gripping plates in the closing direction are adjusted. With this arrangement, however, since a multiple of compression coil springs must be adjusted one by one, a long period of time and much labor are needed. Also, the gripping force cannot be sufficiently changed by changing only the spring forces.

Furthermore, in a cam closed type plate lockup apparatus in which the gripping plates are pivoted in the closing direction by cams and in the open direction by the spring forces of spring members, to adjust the plate gripping force of the lockup device, shims are inserted between the cam surfaces of the cams and the gripper plates. Hence, a long period of time and much labor are needed, as in the above case.

SUMMARY OF THE INVENTION

It is, therefore, an object of the present invention to provide a plate lockup apparatus for a printing press in which adjustment of a gripping force in accordance with the thickness of a plate is easily performed.

It is another object of the present invention to provide a plate lockup apparatus for a printing press in which an adjusting time of the gripping force is shortened to improve the operating efficiency of the printing press.

It is still another object of the present invention to provide a plate lockup apparatus for a printing press in which erroneous plate gripping is eliminated to improve the precision of the printing press.

In order to achieve the above objects of the present invention, there is provided a plate lockup apparatus for a printing press, comprising a plate lockup table located in a gap of a circumferential surface of a plate cylinder and extending in an axial direction of the plate cylinder, a gripper plate pivotally supported on the plate lockup table such that a gripper surface thereof opposes to contact a gripper surface of the plate lockup table and extending in the axial direction of the plate cylinder, a spring member for biasing the gripper plate in a plate releasing direction, an actuating member fixed on the gripping plate and extending in a radial direction of the plate cylinder, a cam shaft, extending along the actuating member to be pivotal in the axial direction of the plate cylinder such that a cam surface thereof opposes to contact the actuating member, for swinging, by cooperation with the spring member, the gripper plate in the plate gripping direction and a plate releasing direction with respect to the plate lockup table through the actuating member, and an adjusting member for acting on the actuating member to adjust a relative position between the gripper surfaces.

DETAILED DESCRIPTION OF THE PREFERRED EMBODIMENT

Figure 1:
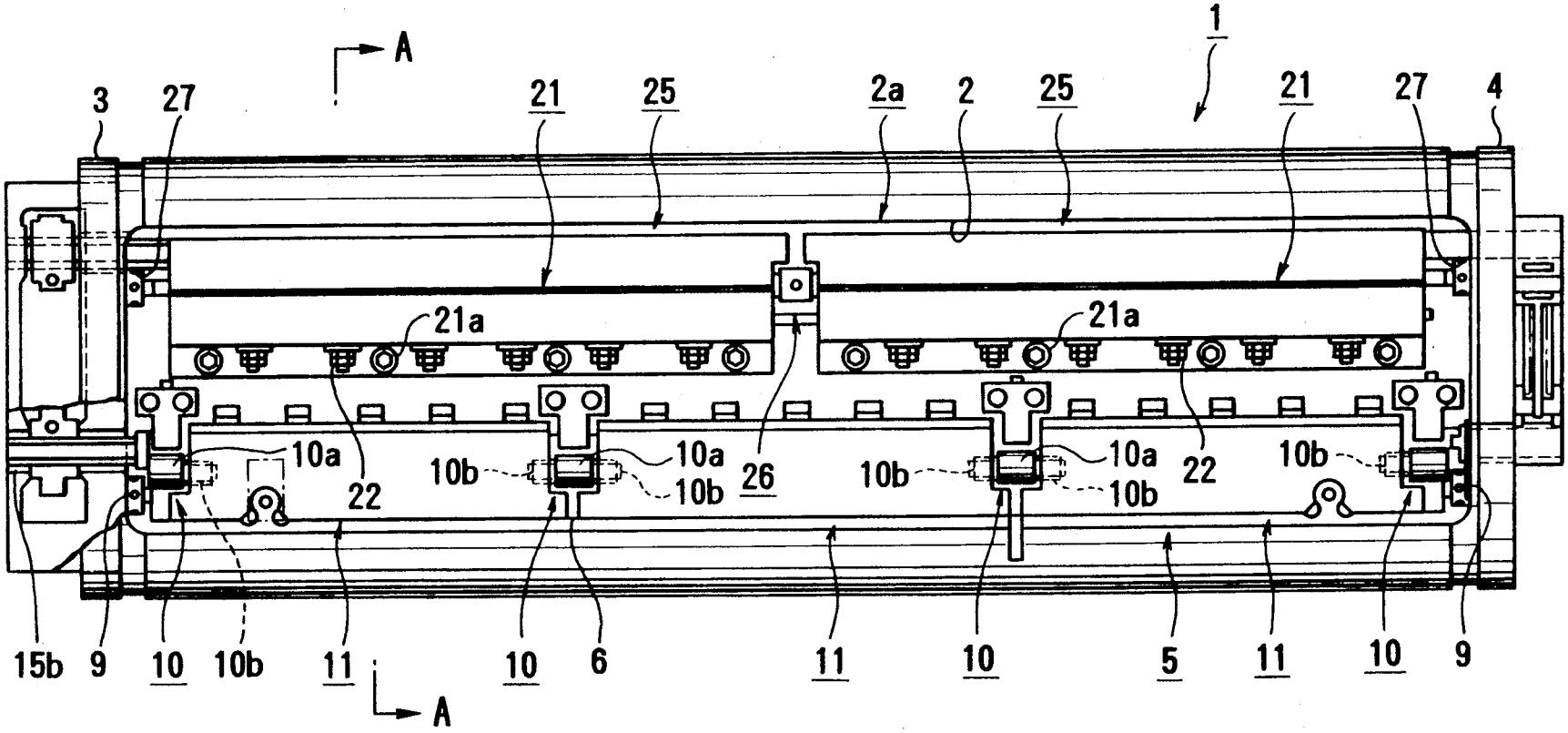
FIG. 1 is a plan view of a plate cylinder of a plate lockup apparatus for a printing press according to the present invention.
Figure 2:
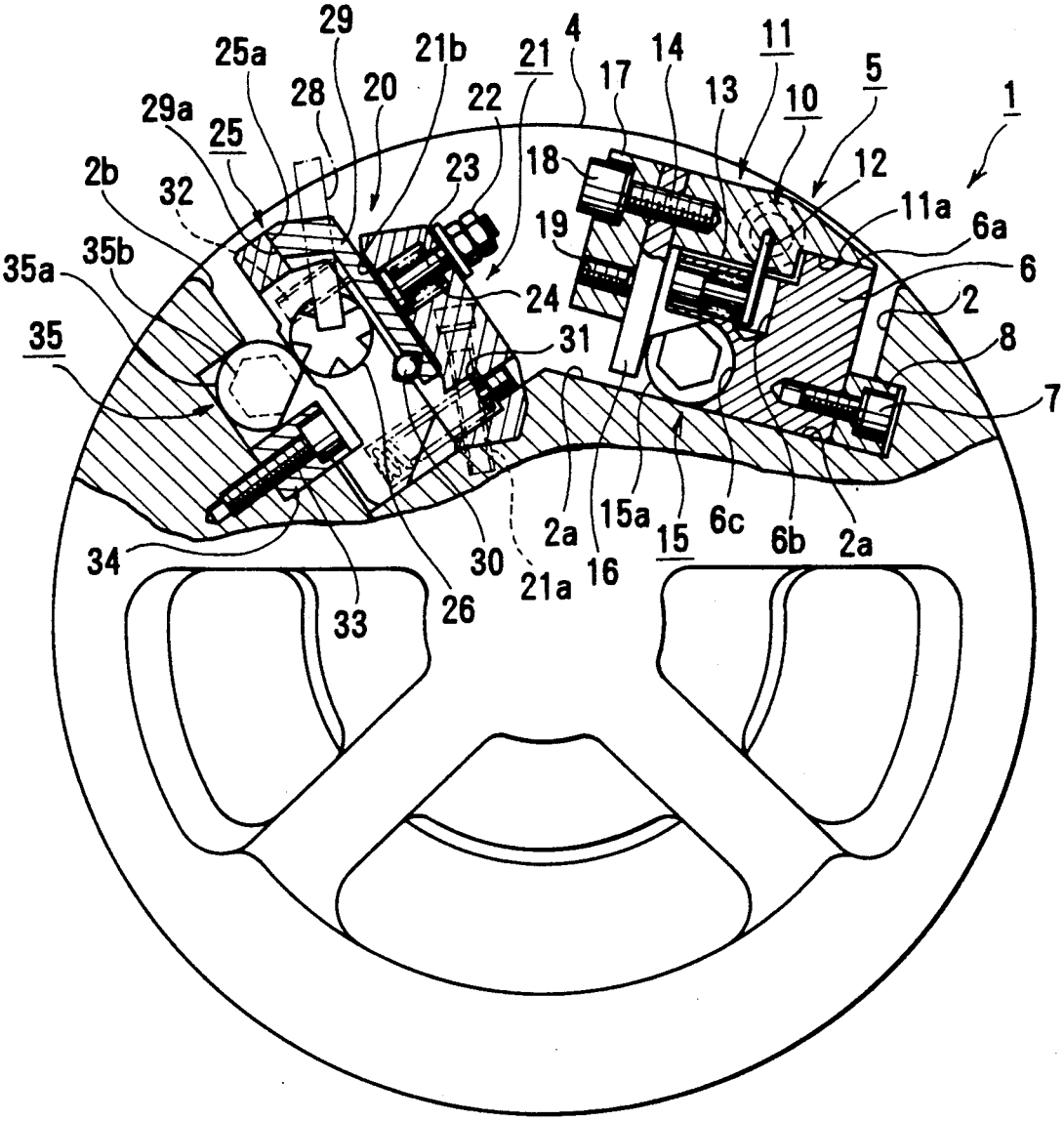
FIG. 2 is a sectional view taken along the line A—A of FIG. 1.

FIGS. 1 and 2 show a plate lockup apparatus for a printing press according to an embodiment of the present invention. Referring to FIGS. 1 and 2, a gap 2 having an almost rectangular section and an inverted V-shaped bottom surface is formed in the circumferential surface of a plate cylinder 1 along almost the overall length of the plate cylinder 1. Disc-like bearers 3 and close openings at two ends of the gap 2. A leading-side plate lockup device 5 has a plate lockup table 6 formed to have almost a square section and extending in the axial direction of the plate cylinder 1. The plate lockup table 6 is fixed on the side of a bottom surface 2*a* of the gap 2 by fixing a plurality of blocks 8, fixed to the plate lockup table 6 by bolts 7, on the bottom surface 2*a* of the gap 2 by bolts (not shown). Adjusting screws 9 are interposed between the plate lockup table 6 and the right and left bearers 3 and 4. Each adjusting screw 9 has threaded portions at its two sides screwed in the corresponding screw holes in the bear 3 or 4 and the plate lockup table 6. When a wrench is inserted in a hole in the circumferential surface of the plate cylinder 1 and turned, the position of the plate lockup table 6 is finely adjusted in the axial direction of the plate cylinder 1.

Support bolts 10 each having a semispherical head 10*a* are fixed at two end portions and two intermediate portions of the plate lockup table 6. Three gripper plates 11 having an overall length almost equal to that of the plate lockup table 6 and divided as three pieces in the axial direction of the plate cylinder 1 are swingably supported on the plate lockup table 6 by inserting pins 10*b*, horizontally projecting in two sides of the heads 10*a*, in pin holes, as shown in FIG. 1. A spring reception member 12 is inserted and fixed in the groove of each gripper plate 11 to extend along the bottom surface 2*a* of the gap 2. The lower half of the spring reception member 12 is engaged in a groove 6*b* of the plate lockup table 6. Compression coil springs 13 are inserted in holes of the plate lockup table 6 to be located between the heads of pins 14 and the spring reception members 12. The gripper plates 11 are biased by the compression coil springs 13 through the spring reception members 12 so as to rotate counterclockwise in FIG. 2. A recessed gripper surface 6*a* is formed in the plate lockup table 6, and projecting gripper surfaces 11*a* are formed on the gripping plates 11.

A cam surface 15*a* of a cam shaft 15 consisting of arcuated and linear portions is pivotally fitted in a semicircular hole 6*c* formed in the plate lockup table 6 to extend along the overall length of the plate lockup table 6. A flexible plate 16 extends from the end face of each gripper plate 11 along the bottom surface 2*a* of the gap 2. The flexible plate 16 is urged by a press plate 17 and fixed by a bolt 18. The cam surface 15*a* opposes to contact the flat surface of the plate 16, the cam shaft 15 is pivotally supported in the holes of the bearers 3 and 4, and an hexagonal head 15*b* formed on one end of the cam shaft 15 projects from the hole of the bearer 3 to the outside. With this arrangement, when the cam shaft 15 is pivoted by the drive unit or by manually operating the wrench engaged with the hexagonal head 15*b* so that the arcuated portion of the cam surface is urged against the plate 16, the gripper plates 11 swing counterclockwise in FIG. 2 about the four support bolts 10 as the center against the spring forces of the compression coil springs 13 compressed by the spring reception members 12, to close the gripper surfaces 6*a* and 11*a*. After this state, when the cam shaft 15 is pivoted and the linear portion of the cam surface opposes to contact the plate 16, the gripper plates 11 swing counterclockwise in FIG. 2 because of the spring forces of the compression coil springs 13 to open the gripper surfaces 6*a* and 11*a*. A push screw 19 serving as an actuator is screwed in the screw hole of each press plate 17. When the push screw 19 is turned and moved backward or forward, the plate 16 is slightly flexed to slightly pivot the gripper plate 11, thereby adjusting the gripping forces by the gripper surfaces 6*a* and 11*a*. The plate lockup table 6 is biased toward the wall surface of the gap 2 by a compression coil spring (not shown).

A trailing-side plate lockup device 20 will be described. The trailing-side plate lockup device 20 is disposed in the gap 2 to be parallel to the leading-side plate lockup device 5 and has a spring reception bar 21 having almost the same length as that of the gap 2 and a vertical surface perpendicular to the bottom surface 2*a* of the gap 2. The spring reception bar 21 is fixed on the bottom surface 2*a* of the gap 2 by a plurality of bolts 21*a*. The spring reception bar 21 has a regulating surface 21*b* extending in the radial direction of the plate cylinder 1. A collared pin 23 having a double nut 22 so as to be freely adjustable is inserted in a spring hole formed in the regulating surface 21*b* while it is biased by a compression coil spring 24 toward the regulating surface 21*b*. Two plate lockup tables 25 extending along the axis of the plate cylinder 1 are disposed between the spring reception bar 21 and the wall surface 2*b* of the gap 2. The plate lockup tables 25 are two pieces divided in the longitudinal direction. The right and left split plate lockup tables 25 are coupled by a metal joint member 26 serving as a moving unit, as shown in FIG. 1, and an adjusting metal member 27 is interposed between each of the left and right bearers 3 and 4 and the adjacent plate lockup table 25. The right- and left-hand threads of the metal joint member 26 are screwed in the screw holes of the left and right plate lockup tables 25, respectively. When a wrench 28 is inserted in the pin hole of the metal joint member 26 and turned, the plate lockup devices 25 are moved in the opposite directions to be spaced apart from each other, thereby finely adjusting the overall length of the plate lockup tables 25. When the wrench 28 is inserted in the pin hole of the metal adjusting member 27 and turned, the corresponding plate lockup table 25 is moved in the axial direction of the plate cylinder 1 to finely adjust the overall length of the plate lockup tables 25.

Gripper plates 29 each having a substantially L-shaped section and extending in the axial direction of the plate cylinder 1 are disposed between the spring reception bar 21 and the plate lockup tables 25, and the gripper plates 29 and the plate lockup tables 25 are swingably coupled to each other through a support shaft 30 having substantially the same length as either the gripper plates 29 or the plate lockup tables 25. Compression coil springs 31 for elastically biasing the spring reception bar 21 and the plate lockup tables 25 are disposed between them, and compression coil springs 32 for elastically biasing the gripper plates 29 and the plate lockup tables 25 are disposed between them. A cam shaft 35 having a cam surface 35*a* constituted by arcuated and linear portions is engaged in a recess defined by a block 34, fixed on the wall surface 2*b* of the gap 2 by a bolt 33, and the wall surface 2*b* of the gap 2, such that angular heads 35*b* of the cam shaft 35 are pivotally supported by the bearers 3 and 4. When the cam shaft 35 is manually rotated in this embodiment, gripper surfaces 25*a* of the plate lockup tables 25 and gripper surfaces 29*a* of the gripper plates 29 are opened and closed in sheet-releasing and -gripping states, respectively. Although not shown in the drawings, a cam unit constituted by a cam having linear and arcuated portions and ball plungers for regulating rotation of this cam at plurality of locations is provided between the spring reception bar 21 and the gripper plates 29. The cam unit is fixed on an end face of the spring reception bar 21 on the outer side in the radial direction of the plate cylinder 1.

The operation of the plate lockup apparatus having the arrangement as described above will be described. To mount the plate on the plate cylinder 1, the leading-side plate lockup device 5 is caused to oppose the work surface of the operator, the leading-side cam shaft 15 is pivoted by engaging a wrench or the like with the hexagonal head 15*b*, thereby causing the linear portion of the cam surface 15*a* to oppose the plate 16. Then, since the elastic forces of the compression coil springs 13 act on the spring reception members 12, the gripper plates 11 are pivoted, together with the plates 16, by the elastic forces of the compression coil springs 13, thereby opening the gripper surfaces 6*a* and 11*a*. One end of a plate is inserted between the gripper surfaces 6*a* and 11*a* which are open, and the leading-side cam shaft 15 is pivoted to cause the arcuated portion of the cam surface 15*a* to oppose the corresponding plate 16. Then, the gripper plates 11 are pivoted through the plates 16 to close the gripper surfaces 6*a* and 11*a*, thereby gripping one end of the plate.

After one end of the plate is gripped in this manner, when the plate cylinder 1 is rotated by about one revolution, the plate is wound around the circumferential surface of the plate cylinder 1, and the trailing-side plate lockup device 20 opposes the work surface of the operator. A wrench 28 is engaged with the angular head 35*b* of the trailing-side cam shaft 35 to rotate the trailing-side cam shaft 35. Then, the arcuated portion of the cam surface 35*a* starts opposing to contact the plate lockup tables 25. In the initial stage of rotation of the cam shaft 35, the plate lockup tables 25 and the gripper plates 29 grip the trailing end of the plate against the elastic forces of the compression coil springs 24 and 32. When rotation of the cam shaft 35 is continued to urge the plate lockup tables 25 against the arcuated portion of the cam surface 35*a*, in the final stage of rotation of the cam shaft 35, the plate lockup tables 25 and the gripper plates that grip the plate integrally swing against the elastic forces of the compression coil springs 32, 24, and 31. As a result, the plate is tightened and brought into tight contact with the circumferential surface of the plate cylinder 1.

When printing misregistration occurs due to burning of the plate or stretching of the printing sheet, the trailing end of the plate is gripped between the gripper surfaces 25*a* of the plate lockup tables 25 of the trailing-side plate lockup device 20 and the gripper surfaces 29*a* of the gripper plates 29. The plate lockup tables 25 and the gripper plates 29 are pivoted clockwise in FIG. 2 by the elastic forces of the compression coil springs 31 about the support shaft 30 as the center, and the plate lockup device 20 is in a tightened state. When a tool is inserted in the hole formed in the cam of the cam unit (not shown) to rotate the cam against the elastic forces of the compression coil springs 31, the cam whose linear portion has opposed to contact the free end portions of the gripper plates 29 is pivoted to cause its arcuated portion to oppose to contact the free end portions of the gripper plates 29. Hence, the plate lockup tables 25 and the gripper plates 29 are urged backward and pivoted counterclockwise in FIG. 2 substantially about the cam shaft 35 as the center. As a result, the gripping forces of the gripper surfaces 25*a* and 29*a* are increased, and the tightened plate is slightly loosened.

When the wrench 28 is inserted in the pin hole formed in the metal joint member 26 provided between the left and right split plate lockup tables 25 to pivot the metal joint member 26, the plate lockup tables 25 are moved in the opposite directions to move close to or separate from each other together with the gripper plates 29 by the operations of the right- and left-hand threads formed on the two end portions of the metal joint member 26. Thus, only the trailing end of the plate is shifted in the widthwise direction. In this case, since the plate is loosened and the gripping forces of the plate are increased, the widthwise movement of the plate can be easily performed, and the plate will not slip at the gripping portions. After this, the cam shaft 35 of the cam unit is pivoted to cause its linear portion to oppose to contact the free end portions of the gripper plates 29. Since the plate lockup tables 25 and the gripper plates 29 are caused by the elastic forces of the compression coil springs 31 to swing about the support shaft 30 as the center, the plate is tightened and brought into tight contact with the circumferential surface of the plate cylinder 1. At this time, although the plate gripping forces are slightly weakened, the plate will not slip since it is permanently deformed.

In order to remove the plate from this state, the trailing-side cam shaft 35 is rotated to cause the linear portion of the cam surface to oppose to contact the plate lockup tables 25. Then, the plate lockup tables 25 and the gripping plates 29 are opened by the spring forces of the compression coil springs 24 and 32 to release the trailing end of the plate. The plate cylinder 1 is rotated by almost one revolution to cause the leading-side plate lockup device 5 to oppose the work surface of the operator, and the leading-side cam shaft 15 is pivoted to cause the linear portion of the cam surface to oppose the flat surfaces of the plates 16. Then, the gripping plates 11 swing through the plates 16 to open the gripper surfaces 6*a* and 11*a*, thereby releasing the plate to complete the plate removing operation.

When the gripping force of the leading-side plate lockup device 5 is to be adjusted because the plate thickness is changed or the plate gripping force is decreased, the push screw 19 screwed in the screw hole of the press plate 17 is rotated to move forward or backward. Then, the plates 16 are flexed to change the gap between the free end portions of the plates 16 and the press plate 17, and the relative position, i.e., the angle defined by the cam surface 15*a* of the cam shaft 15 and the plate gripper surfaces 6*a* and 11*a* is changed, thereby adjusting the plate gripping force.

In this embodiment, the push screw 19 is used as an urging member to flex the plates 16 in order to adjust the plate gripping force. However, the present invention is not limited to this, and the plates 16 can be flexed by using, e.g., a cam.

As is apparent from the above description, in the plate lockup apparatus for a printing press according to the present invention, the plate gripping force can be easily changed upon a change in plate thickness or the like only by operating the urging member that swings the plates. Therefore, the adjusting time is shortened compared to that in the conventional apparatus, the operating efficiency of the machine is improved, and the labor can be decreased. Furthermore, since the play in the plate gripping mechanism can be absorbed, erroneous plate gripping can be prevented to improve precision of the apparatus. Also, if a plurality of plate urging members are provided, the right and left gripping forces of the plate lockup devices can be easily adjusted.

What is claimed is:

1. A plate lockup apparatus for a printing press, comprising:

a plate lockup table with a first gripper surface located in a gap of a circumferential surface of a plate cylinder and extending in an axial direction of said plate cylinder;

a gripper plate with a second gripper surface pivotally supported on said plate lockup table such that said second gripper surface opposes and contacts said first gripper surface of said plate lockup table and extends in the axial direction of said plate cylinder;

a spring member for biasing said gripper plate in a plate releasing direction;

an actuating member fixed on said gripping plate and extending in a radial direction of said plate cylinder;

a cam shaft extending along said actuating member to be pivotal in an axial direction parallel to the axial direction of said plate cylinder such that a cam surface thereof opposes and contacts said actuating member, for swinging, by cooperating with said spring member, said gripper plate disposed in the plate gripping direction and in a plate releasing direction with respect to said plate lockup table through said actuating member; and an adjusting member for acting on said actuating member to adjust a relative position between said first gripper surface and said second gripper surface, wherein said adjusting member is an urging member which moves forward and backward to urge said actuating member against said cam shaft, thereby swinging said actuating member.

2. An apparatus according to claim 1, wherein said actuating member comprises a flexible plate having one end fixed to said gripper plate, the other end as a free end, and a flat surface to oppose and contact said cam surface of said cam shaft, and said adjusting member acting on said flexible plate with one end fixed to said gripper plate and the other end held by said cam surface of said cam shaft, thereby adjusting an angle defined by said flat surface of said flexible plate and said gripper surface.

3. An apparatus according to claim 1, wherein said adjusting member comprises a push screw which is pivoted to move forward and backward.

4. An apparatus according to claim 1, further comprising a press plate extending in a radial direction of said plate cylinder to press said actuating member, and a bolt for fixing said actuating member interposed between said gripper plate and said press plate, and wherein said adjusting member moves toward and apart from said press plate to act on said actuating member.

* * * * *